US007385568B2

(12) United States Patent
Chen et al.

(10) Patent No.: US 7,385,568 B2
(45) Date of Patent: Jun. 10, 2008

(54) DRIVING CIRCUIT OF PLASMA DISPLAY PANEL

(75) Inventors: Bi-Hsien Chen, Ping-Tung Hsien (TW); Yi-Min Huang, Taipei (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 189 days.

(21) Appl. No.: 11/425,689

(22) Filed: Jun. 21, 2006

(65) Prior Publication Data

US 2006/0290604 A1 Dec. 28, 2006

Related U.S. Application Data

(60) Provisional application No. 60/595,299, filed on Jun. 22, 2005.

(51) Int. Cl.
*G09G 3/28* (2006.01)

(52) U.S. Cl. ..... 345/66; 345/63

(58) Field of Classification Search ..... 345/37, 345/41, 42, 60, 63, 66; 315/169.3, 169.4; 313/567

See application file for complete search history.

(56) References Cited

U.S. PATENT DOCUMENTS 5,670,974 A 9/1997 Ohba et al.
6,628,275 B2 * 9/2003 Vossen et al. ..... 345/211
6,680,581 B2 * 1/2004 Lee et al. ..... 315/169.3
6,768,270 B2 * 7/2004 Chae ..... 315/169.3
6,781,322 B2 * 8/2004 Onozawa et al. ..... 315/169.3
6,933,679 B2 * 8/2005 Lee et al. ..... 315/169.4
6,961,031 B2 * 11/2005 Lee et al. ..... 345/60
7,023,139 B2 * 4/2006 Lee et al. ..... 315/169.1
7,027,010 B2 * 4/2006 Lee ..... 345/60
7,123,219 B2 * 10/2006 Lee ..... 345/76
7,176,854 B2 * 2/2007 Lee et al. ..... 345/60
2003/0173905 A1 * 9/2003 Lee et al. ..... 315/169.3
2003/0193454 A1 * 10/2003 Lee et al. ..... 345/63
2004/0012546 A1 * 1/2004 Takagi et al. ..... 345/60
2004/0135746 A1 * 7/2004 Lee et al. ..... 345/60
2006/0238447 A1 * 10/2006 Chen ..... 345/60
2006/0267874 A1 * 11/2006 Chen et al. ..... 345/68

* cited by examiner

*Primary Examiner*—Ricardo Osorio
(74) *Attorney, Agent, or Firm*—Winston Hsu

(57) ABSTRACT

A plasma display panel driving circuit includes a panel capacitor having a first side and a second side, a diode electrically connected between the first side of the panel capacitor and a first voltage, a first switch electrically connected between the first voltage and a first node, a second switch electrically connected between the first node and the second side of the panel capacitor, an inductor and a third switch electrically connected in series between the first node and the first side of the panel capacitor, a fourth switch electrically connected between the second side of the panel capacitor and a second voltage, and a fifth switch electrically connected between the first side of the panel capacitor and the second voltage.

13 Claims, 10 Drawing Sheets

DRIVING CIRCUIT OF PLASMA DISPLAY PANEL

CROSS REFERENCE TO RELATED APPLICATIONS

This application claims the benefit of the filing date of U.S. provisional patent application No. 60/595,299, filed Jun. 22, 2005, the contents of which are hereby incorporated by reference.

BACKGROUND OF THE INVENTION

1. Field of the Invention

The present invention relates to a driving circuit, and more specifically, to a driving circuit for a plasma display panel (PDP).

2. Description of the Prior Art

In a plasma display panel (PDP), charges are accumulated in cells according to display data, and a sustaining discharge pulse is applied to paired electrodes of the cells in order to discharge inert gas, generate ultraviolet, excite fluorescent material, and emit visible light to effect display. As far as the PDP display is concerned, a high voltage is required to be applied to the electrodes, and a pulse-duration of several microseconds is usually required. Hence the power consumption of a PDP display is considerable. Energy recovering (power saving) is therefore important. Many designs and patents have been developed for providing methods and apparatuses for energy recovery in PDPs. One example is taught in U.S. Pat. No. 5,670,974 ('974), entitled "Energy Recovery Driver for a Dot Matrix AC Plasma Display Panel with a Parallel Resonant Circuit Allowing Power Reduction" to Ohba et al., which is incorporated herein by reference.

Please refer to FIG. 1 which illustrates a circuit diagram of a PDP driving circuit 100 according to the '974 patent. The PDP driving circuit 100 comprises an equivalent panel capacitor Cp having an X side and a Y side, four switches S1 to S4 for permitting current to pass as part of a voltage clamp circuit, and a charging/discharging circuit that includes two switches S5 and S6 with body diodes, two diodes D1 and D2, and an inductor L1. The PDP driving circuit 100 requires the two switches S5 and S6 in order to allow two-direction discharge, which is required for energy recovery. That is, the two switches S5 and S6 achieve two paths that allow ineffective power from the X side of the panel capacitor Cp to be recovered to the Y side and vice versa.

In operation, the switches S1 to S6 are controlled to provide panel capacitor Cp voltages as shown in FIG. 2. In plot of voltage waveform 204, the individual voltages of the X side (dashed line) and Y side (solid line) of the panel capacitor Cp are shown to vary between 0 and Vs. Plot 202 shows the voltage across the panel capacitor Cp, which is the voltage of the Y side minus the voltage of the X side. The voltage across the panel capacitor Cp varies between Vs and −Vs.

The prior art suffers from several disadvantages. First, the requirement for six switches S1 to S6 increases the space required on a semiconductor integrated circuit. Second, two diodes D1 and D2 are required, further increasing the required circuit space.

SUMMARY OF THE INVENTION

It is therefore an objective of the invention to provide a plasma display panel driver circuit that solves the problems of the prior art.

Briefly summarized, the claimed plasma display panel driving circuit includes a panel capacitor having a first side and a second side, a diode electrically connected between the first side of the panel capacitor and a first voltage, a first switch electrically connected between the first voltage and a first node, a second switch electrically connected between the first node and the second side of the panel capacitor, an inductor and a third switch electrically connected in series between the first node and the first side of the panel capacitor, a fourth switch electrically connected between the second side of the panel capacitor and a second voltage, and a fifth switch electrically connected between the first side of the panel capacitor and the second voltage.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
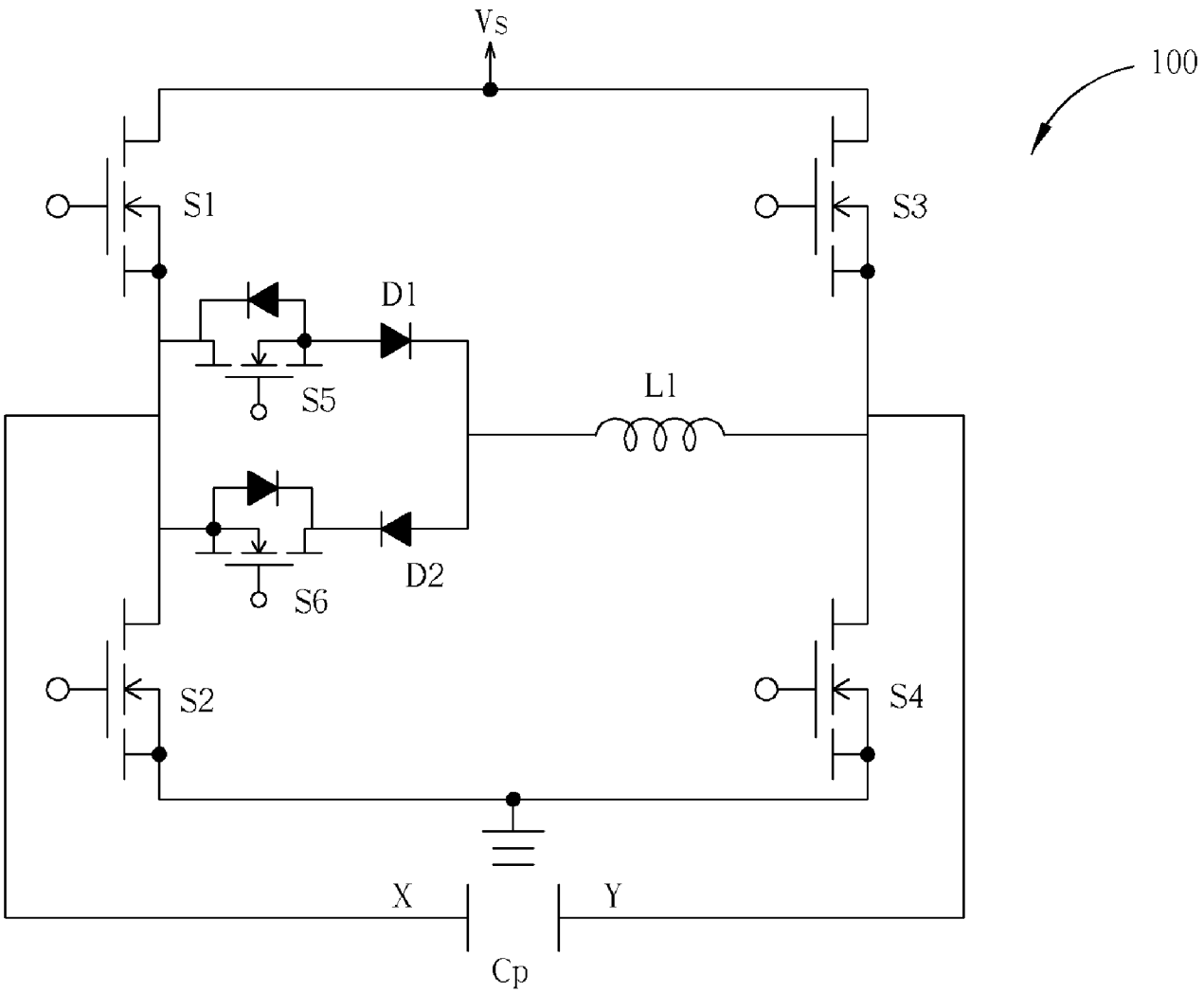
Fig. 1 Prior Art
FIG. 1 is a circuit diagram of a plasma display panel driver circuit according to the prior art.
Figure 2:
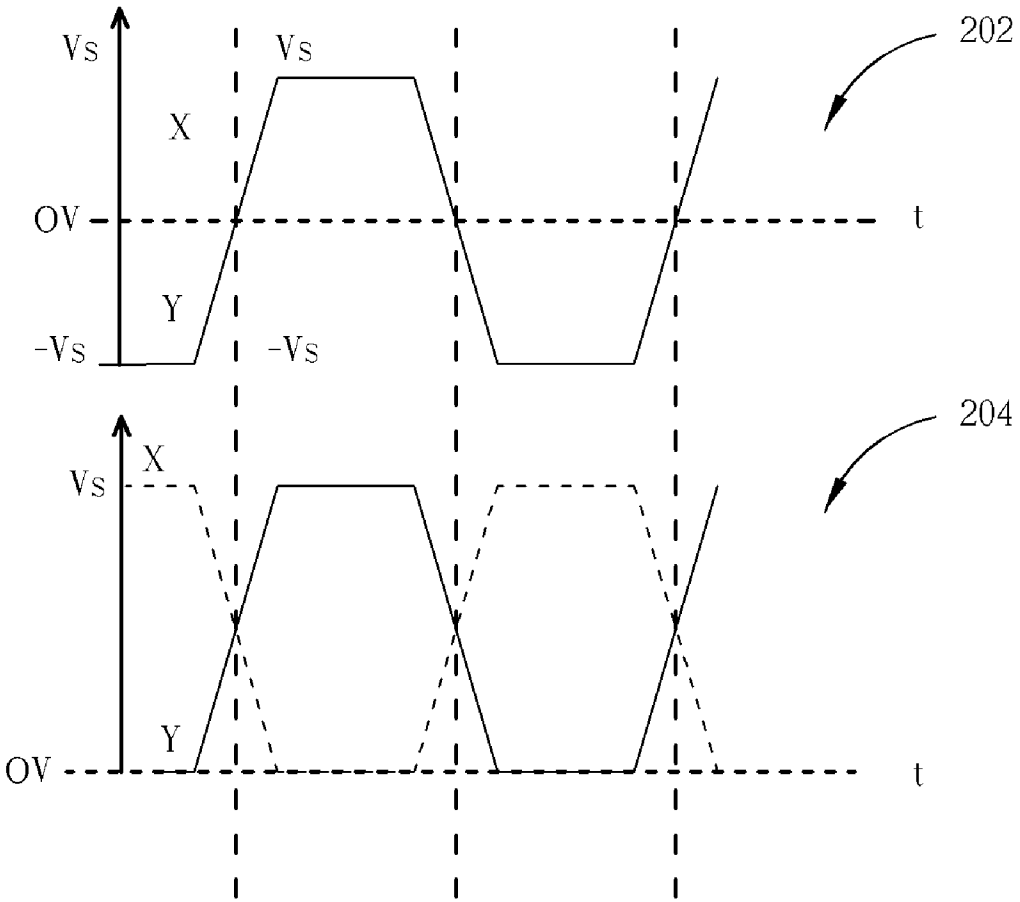
Fig. 2 Prior Art
FIG. 2 shows voltage levels in the circuit of FIG. 1.
Figure 3:
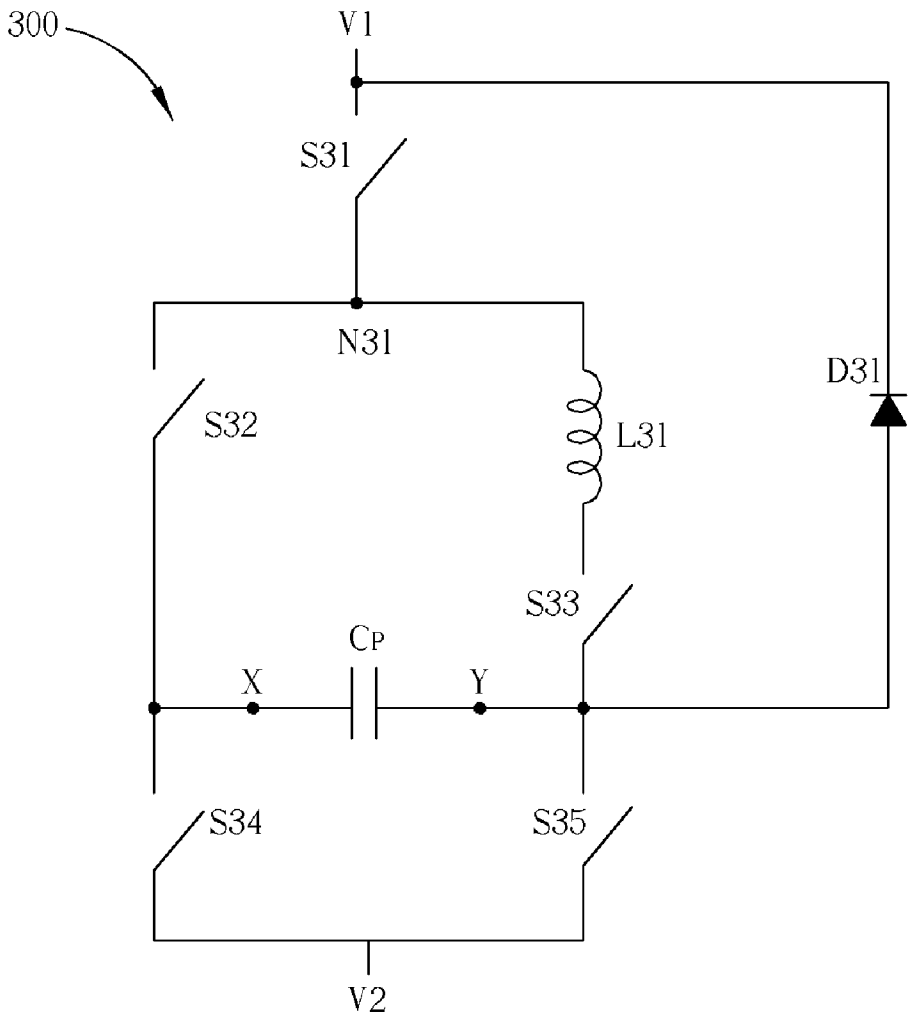
FIG. 3 is a circuit diagram of a plasma display panel driver circuit according to a first embodiment of the present invention.

The present invention provides a new driving circuit for the PDP. Please refer to FIG. 3. FIG. 3 is a circuit diagram of a plasma display panel driver circuit 300 according to a first embodiment of the present invention. The driver circuit 300 comprises five switches S31, S32, S33, S34, and S35, a diode D31, and an inductor L31, coupled to an equivalent panel capacitor Cp of a plasma display panel. The driver circuit 300 is electrically connected to a voltage source V1 and a voltage source V2, wherein the voltage potential output by voltage source V1 is greater than the voltage potential output by voltage source V2. The voltage V1 is a positive voltage, whereas the voltage V2 can be ground or a negative voltage.

The switch S31 is electrically connected between the voltage source V1 and a node N31. The switch S32 is electrically connected between the node N31 and an X side of the panel capacitor Cp. The switch S33 and the inductor L31 couple in series between the node N31 and a Y side of the panel capacitor Cp. The switch S34 is electrically connected between the X side of the panel capacitor Cp and voltage source V2, whereas the switch S35 is electrically connected between the Y side of the panel capacitor Cp and voltage source V2. The diode D31 is electrically connected between the Y side of the panel capacitor Cp and the voltage source V1. The switches S31 to S35 can be N-type or P-type metal oxide semiconductor (MOS) transistors, other types of transistors, or other switching devices.

Figure 4:
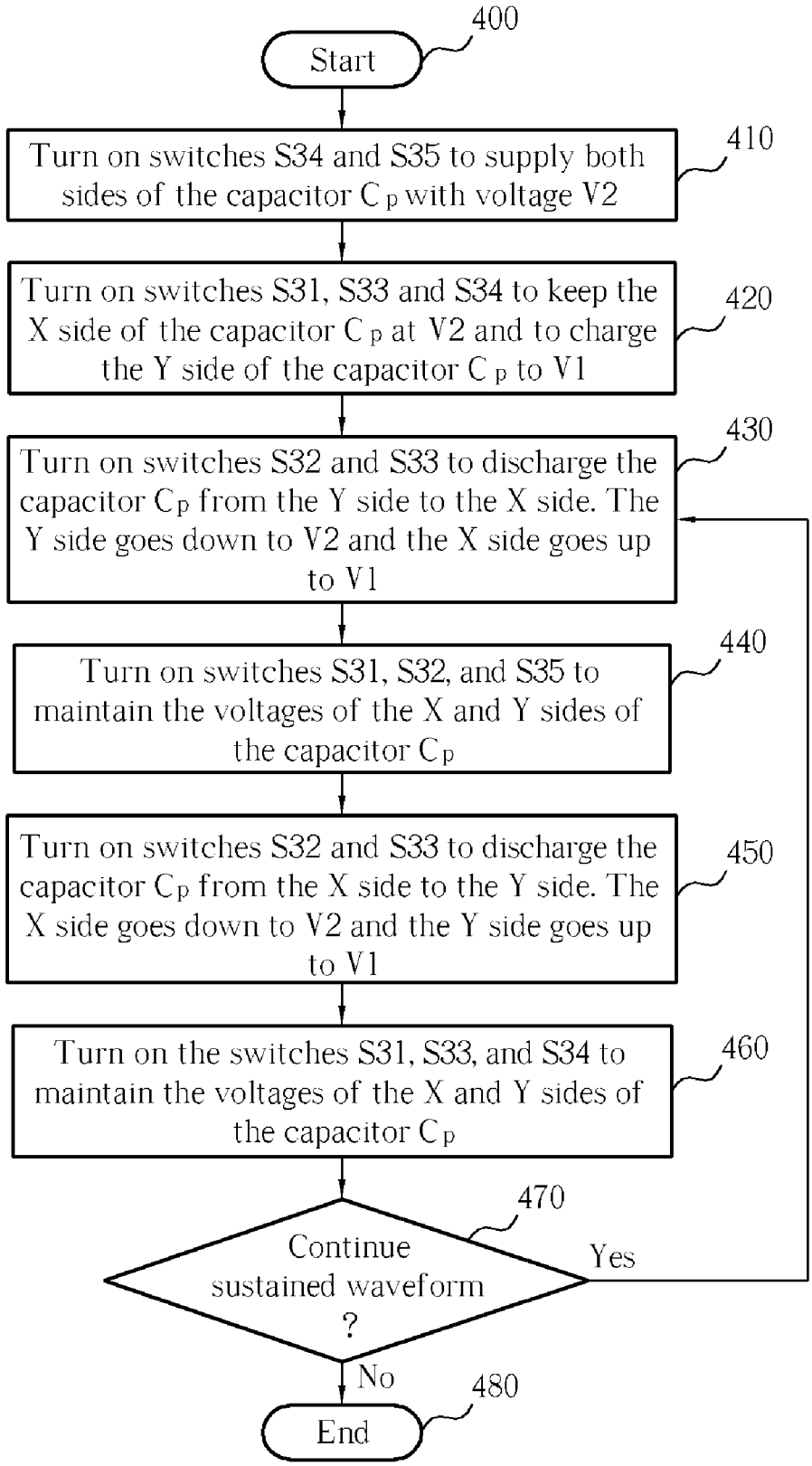
FIG. 4 is a flowchart illustrating the operation of the driver circuit of the first embodiment for creating a sustain waveform.

Please refer to FIG. 4, which illustrates the operation of the driver circuit 300 of the first embodiment for creating a sustain waveform. Steps contained in the flowchart will be explained as follows.

Step 400: Start.

Step 410: Keep the voltage potentials at the X side and the Y side of the panel capacitor Cp at voltage source V2 by turning on the switches S34 and S35.

Step 420: Keep the voltage potential at the X side of the panel capacitor Cp at voltage source V2 and charge the Y side of the panel capacitor Cp by turning on the switches S31, S33, and S34. The voltage potential at the X side of the panel capacitor Cp stays at voltage source V2 through switch S34 and the voltage potential at the Y side of the panel capacitor Cp goes up to V1 and stays at V1 through switch S31, inductor L31, switch S33, and diode D31 accordingly.

Step 430: Discharge the panel capacitor Cp from the Y side to the X side by turning on the switches S32 and S33. The voltage potential at the X side of the panel capacitor Cp goes up to V1 and the voltage potential at the Y side of the panel capacitor Cp goes down to voltage source V2 accordingly and the path is through switch S33, inductor L31, and switch S32.

Step 440: Keep the voltage potential at the X side of the panel capacitor Cp at V1 by turning on the switches S31 and S32. Keep the voltage potential at the Y side of the panel capacitor Cp at voltage source V2 by turning on the switch S35.

Step 450: Discharge the panel capacitor Cp from the X side to the Y side by turning on the switches S32 and S33. The voltage potential at the X side of the panel capacitor Cp goes down to voltage source V2 and the voltage potential at the Y side of the panel capacitor Cp goes up to V1 accordingly and the path is through switch S32, inductor L31, and switch S33.

Step 460: Keep the voltage potential at the X side of the panel capacitor Cp at voltage source V2 by turning on the switch S34. Keep the voltage potential at the Y side of the panel capacitor Cp at V1 by turning on the switches S31 and S33.

Step 470: Go to step 430 if the sustain waveform is continued. Otherwise, go to step 480.

Step 480: End.

The final status of the sustain waveform can keep the voltage potential at the X side of the panel capacitor Cp at voltage source V2 and the voltage potential at the Y side of the panel capacitor Cp at V1, or can keep the voltage potential at the X side of the panel capacitor Cp at V1 and the voltage potential at the Y side of the panel capacitor Cp at voltage source V2 or others. It will depend on waveform design.

The initial status of the sustain waveform can keep the voltage potentials at the X side and Y side of the panel capacitor Cp at voltage source V2, can keep the voltage potential at the X side of the panel capacitor Cp at voltage source V2 and the voltage potential at the Y side of the panel capacitor Cp at V1, or can keep the voltage potential at the X side of the panel capacitor Cp at V1 and the voltage potential at the Y side of the panel capacitor Cp at voltage source V2. According to the different initial statuses, it can start from the different steps.

In addition, it is possible to turn off switch S32 in step 450 and to turn on switch S31 in step 460 before the voltage potential at the X side of the panel capacitor Cp reaches voltage source V2 and before the voltage potential at the Y side of the panel capacitor Cp reaches V1 accordingly.

Figure 5:
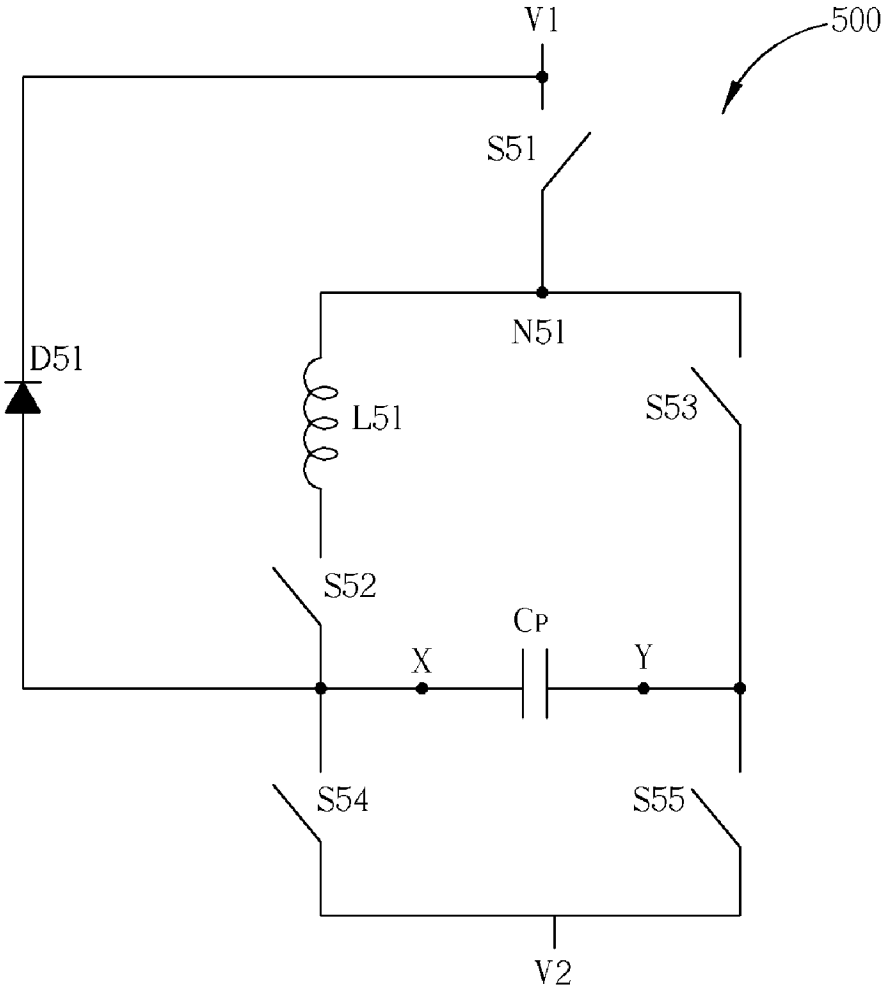
FIG. 5 is a circuit diagram of a plasma display panel driver circuit according to a second embodiment of the present invention.

Please refer to FIG. 5. FIG. 5 is a circuit diagram of a plasma display panel driver circuit 500 according to a second embodiment of the present invention. The driver circuit 500 comprises five switches S51, S52, S53, S54, and S55, a diode D51, and an inductor L51, coupled to an equivalent panel capacitor Cp of a plasma display panel. The driver circuit 500 is electrically connected to a voltage source V1 and a voltage source V2, wherein the voltage potential output by voltage source V1 is greater than the voltage potential output by voltage source V2. The voltage V1 is a positive voltage, whereas the voltage V2 can be ground or a negative voltage. Compared with the driver circuit 300 shown in FIG. 3, the driver circuit 500 switches the orientation of the X and Y sides of the panel capacitor Cp.

The switch S51 is electrically connected between the voltage source V1 and a node N51. The switch S52 and the inductor L51 couple in series between the node N51 and an X side of the panel capacitor Cp. The switch S53 is electrically connected between the node N51 and a Y side of the panel capacitor Cp. The switch S54 is electrically connected between the X side of the panel capacitor Cp and voltage source V2, whereas the switch S55 is electrically connected between the Y side of the panel capacitor Cp and voltage source V2. The diode D51 is electrically connected between the X side of the panel capacitor Cp and the voltage source V1.

Figure 6:
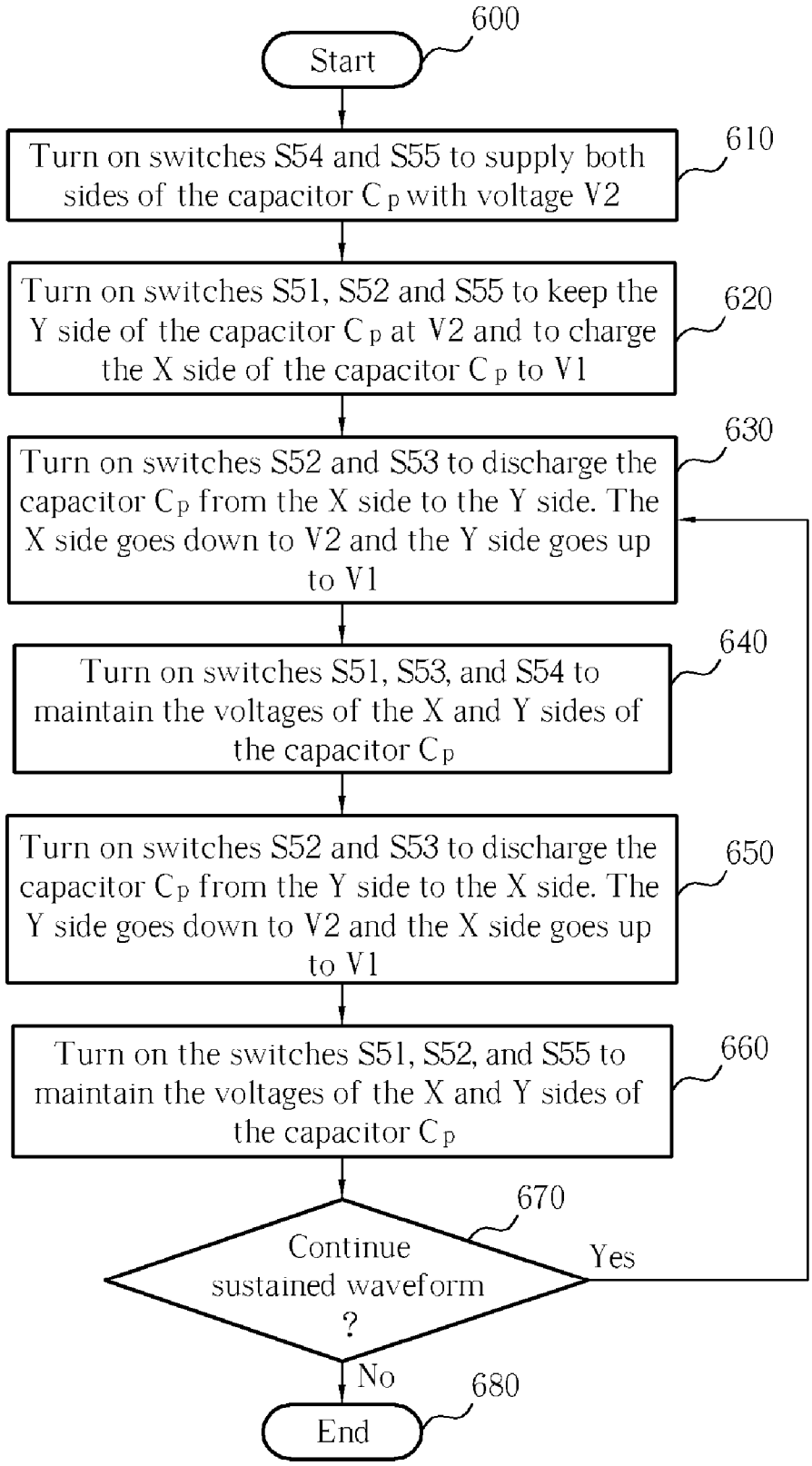
FIG. 6 is a flowchart illustrating the operation of the driver circuit of the second embodiment for creating a sustain waveform.

Please refer to FIG. 6, which illustrates the operation of the driver circuit 500 of the second embodiment for creating a sustain waveform. Steps contained in the flowchart will be explained as follows.

Step 600: Start.

Step 610: Keep the voltage potentials at the X side and the Y side of the panel capacitor Cp at voltage source V2 by turning on the switches S54 and S55.

Step 620: Keep the voltage potential at the Y side of the panel capacitor Cp at voltage source V2 and charge the X side of the panel capacitor Cp by turning on the switches S51, S52, and S55. The voltage potential at the Y side of the panel capacitor Cp stays at voltage source V2 through switch S54 and the voltage potential at the X side of the panel capacitor Cp goes up to V1 and stays at V1 through switch S51, inductor L51, switch S52, and diode D51 accordingly.

Step 630: Discharge the panel capacitor Cp from the X side to the Y side by turning on the switches S52 and S53. The voltage potential at the Y side of the panel capacitor Cp goes up to V1 and the voltage potential at the X side of the panel capacitor Cp goes down to voltage source V2 accordingly and the path is through switch S52, inductor L51, and switch S53.

Step 640: Keep the voltage potential at the Y side of the panel capacitor Cp at V1 by turning on the switches S51 and S53. Keep the voltage potential at the X side of the panel capacitor Cp at voltage source V2 by turning on the switch S54.

Step 650: Discharge the panel capacitor Cp from the Y side to the X side by turning on the switches S52 and S53. The voltage potential at the Y side of the panel capacitor Cp goes down to voltage source V2 and the voltage potential at the X side of the panel capacitor Cp goes up to V1 accordingly and the path is through switch S53, inductor L51, and switch S52.

Step 660: Keep the voltage potential at the Y side of the panel capacitor Cp at voltage source V2 by turning on the switch S55. Keep the voltage potential at the X side of the panel capacitor Cp at V1 by turning on the switches S51 and S52.

Step 670: Go to step 630 if the sustain waveform is continued. Otherwise, go to step 680.

Step 680: End.

The final status of the sustain waveform can keep the voltage potential at the X side of the panel capacitor Cp at voltage source V2 and the voltage potential at the Y side of the panel capacitor Cp at V1, or can keep the voltage potential at the X side of the panel capacitor Cp at V1 and the voltage potential at the Y side of the panel capacitor Cp at voltage source V2 or others. It will depend on waveform design.

The initial status of the sustain waveform can keep the voltage potentials at the X side and Y side of the panel capacitor Cp at voltage source V2, can keep the voltage potential at the X side of the panel capacitor Cp at voltage source V2 and the voltage potential at the Y side of the panel capacitor Cp at V1, or can keep the voltage potential at the X side of the panel capacitor Cp at V1 and the voltage potential at the Y side of the panel capacitor Cp at voltage source V2. According to the different initial statuses, it can start from the different steps.

In addition, it is possible to turn off switch S53 in step 650 and to turn on switch S51 in step 660 before the voltage potential at the Y side of the panel capacitor Cp reaches voltage source V2 and before the voltage potential at the X side of the panel capacitor Cp reaches V1 accordingly.

Figure 7:
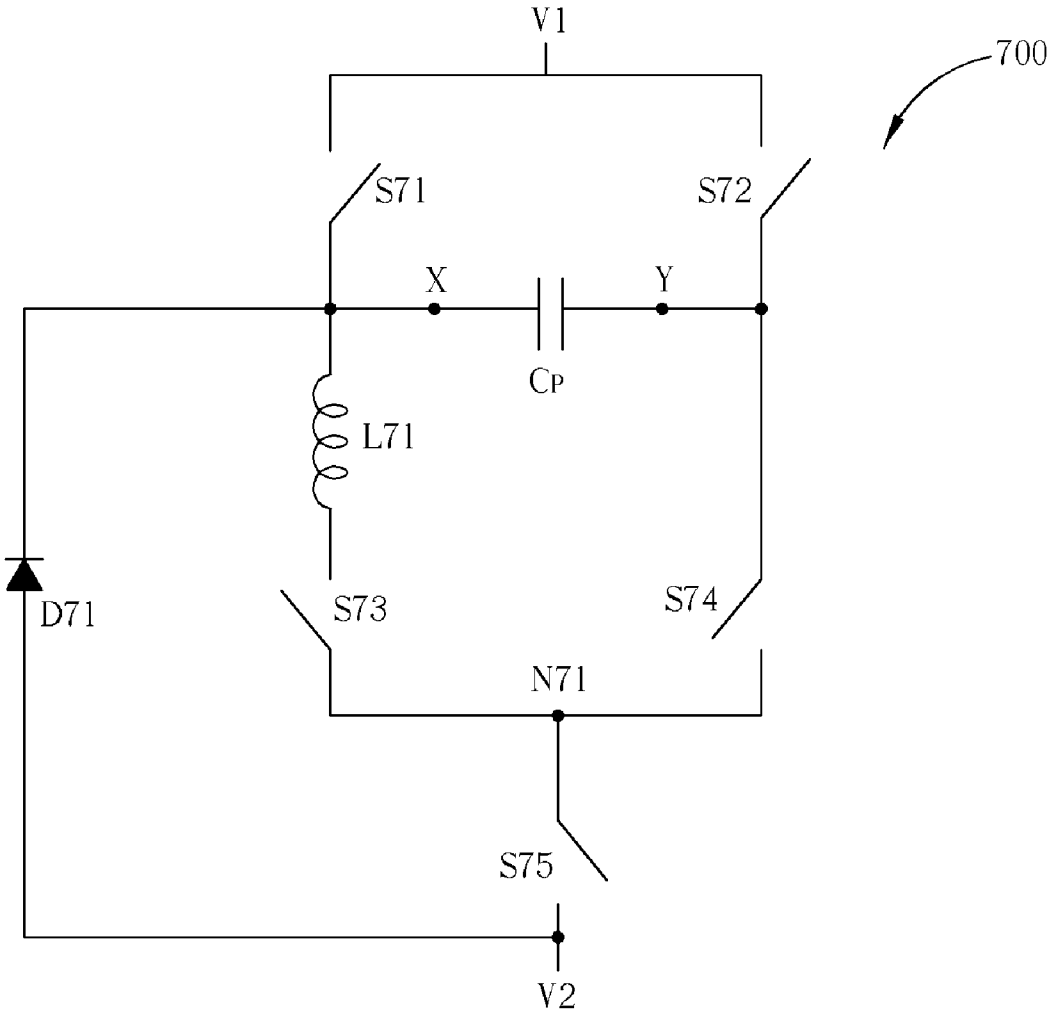
FIG. 7 is a plasma display panel driver circuit according to a third embodiment of the present invention.

Please refer to FIG. 7. FIG. 7 is a circuit diagram of a plasma display panel driver circuit 700 according to a third embodiment of the present invention. The driver circuit 700 comprises five switches S71, S72, S73, S74, and S75, a diode D71, and an inductor L71, coupled to an equivalent panel capacitor Cp of a plasma display panel. The driver circuit 700 is electrically connected to a voltage source V1 and a voltage source V2, wherein the voltage potential output by voltage source V1 is greater than the voltage potential output by voltage source V2. The voltage V1 is a positive voltage, whereas the voltage V2 can be ground or a negative voltage. Compared with the driver circuit 500 shown in FIG. 5, the driver circuit 700 switches the orientation of the voltage source V1 and voltage source V2, along with the direction in which the diode is positioned.

The switch S71 is electrically connected between the voltage source V1 and an X side of the panel capacitor Cp. The switch S72 is electrically connected between the voltage source V1 and a Y side of the panel capacitor Cp. The switch S73 and the inductor L71 couple in series between a node N71 and the X side of the panel capacitor Cp. The switch S74 is electrically connected between the Y side of the panel capacitor Cp and the node N71, and the switch S75 is electrically connected between the node N71 and voltage source V2. The diode D71 is electrically connected between voltage source V2 and the X side of the panel capacitor Cp.

Figure 8:
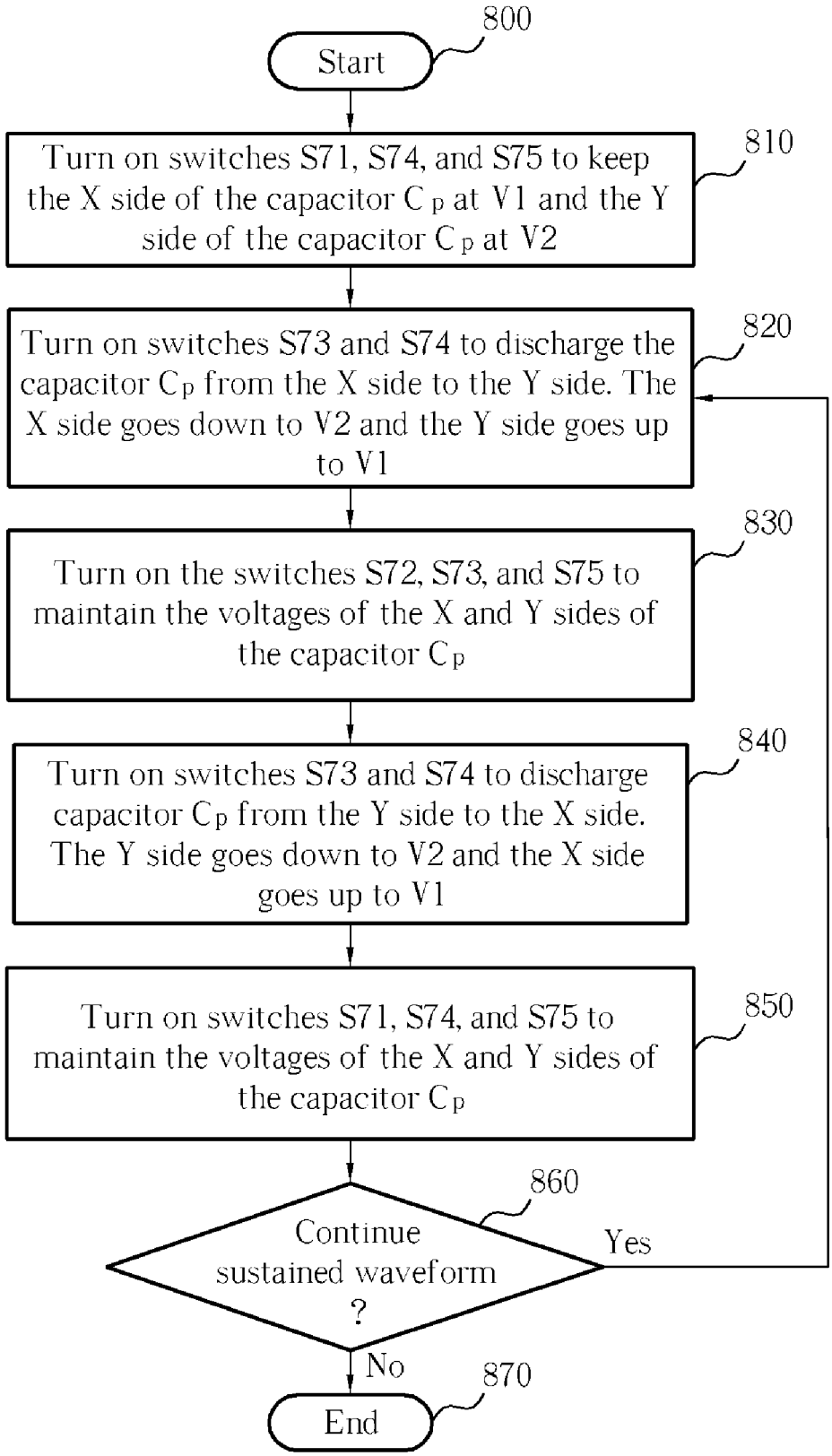
FIG. 8 is a flowchart illustrating the operation of the driver circuit of the third embodiment for creating a sustain waveform.

Please refer to FIG. 8, which illustrates the operation of the driver circuit 700 of the third embodiment for creating a sustain waveform. Steps contained in the flowchart will be explained as follows.

Step 800: Start.

Step 810: Keep the voltage potential at the X side of the panel capacitor Cp at V1 and the Y side of the panel capacitor Cp at voltage source V2 by turning on the switches S71, S74, and S75.

Step 820: Discharge the panel capacitor Cp from the X side to the Y side by turning on the switches S73 and S74. The voltage potential at the X side of the panel capacitor Cp goes down to voltage source V2 and the voltage potential at the Y side of the panel capacitor Cp goes up to V1 accordingly and the path is through inductor L71, switch S73, and switch S74.

Step 830: Keep the voltage potential at the X side of the panel capacitor Cp at voltage source V2 by turning on the switches S73 and S75. Keep the voltage potential at the Y side of the panel capacitor Cp at V1 by turning on the switch S72.

Step 840: Discharge the panel capacitor Cp from the Y side to the X side by turning on the switches S73 and S74. The voltage potential at the X side of the panel capacitor Cp goes up to V1 and the voltage potential at the Y side of the panel capacitor Cp goes down to voltage source V2 accordingly and the path is through switch S74, switch S73, and inductor L71.

Step 850: Keep the voltage potential at the X side of the panel capacitor Cp at V1 by turning on the switch S71. Keep the voltage potential at the Y side of the panel capacitor Cp at voltage source V2 by turning on the switches S74 and S75.

Step 860: Go to step 820 if the sustain waveform is continued. Otherwise, go to step 870.

Step 870: End.

The final status of the sustain waveform can keep the voltage potential at the X side of the panel capacitor Cp at voltage source V2 and the voltage potential at the Y side of the panel capacitor Cp at V1, or can keep the voltage potential at the X side of the panel capacitor Cp at V1 and the voltage potential at the Y side of the panel capacitor Cp at voltage source V2 or others. It will depend on waveform design.

The initial status of the sustain waveform can keep the voltage potential at the X side of the panel capacitor Cp at voltage source V2 and the voltage potential at the Y side of the panel capacitor Cp at V1, or can keep the voltage potential at the X side of the panel capacitor Cp at V1 and the voltage potential at the Y side of the panel capacitor Cp at voltage source V2. According to the different initial statuses, it can start from the different steps.

In addition, it is possible to turn off switch S74 in step 820 and to turn on switch S75 in step 830 before the voltage potential at the X side of the panel capacitor Cp reaches voltage source V2 and before the voltage potential at the Y side of the panel capacitor Cp reaches V1 accordingly.

Figure 9:
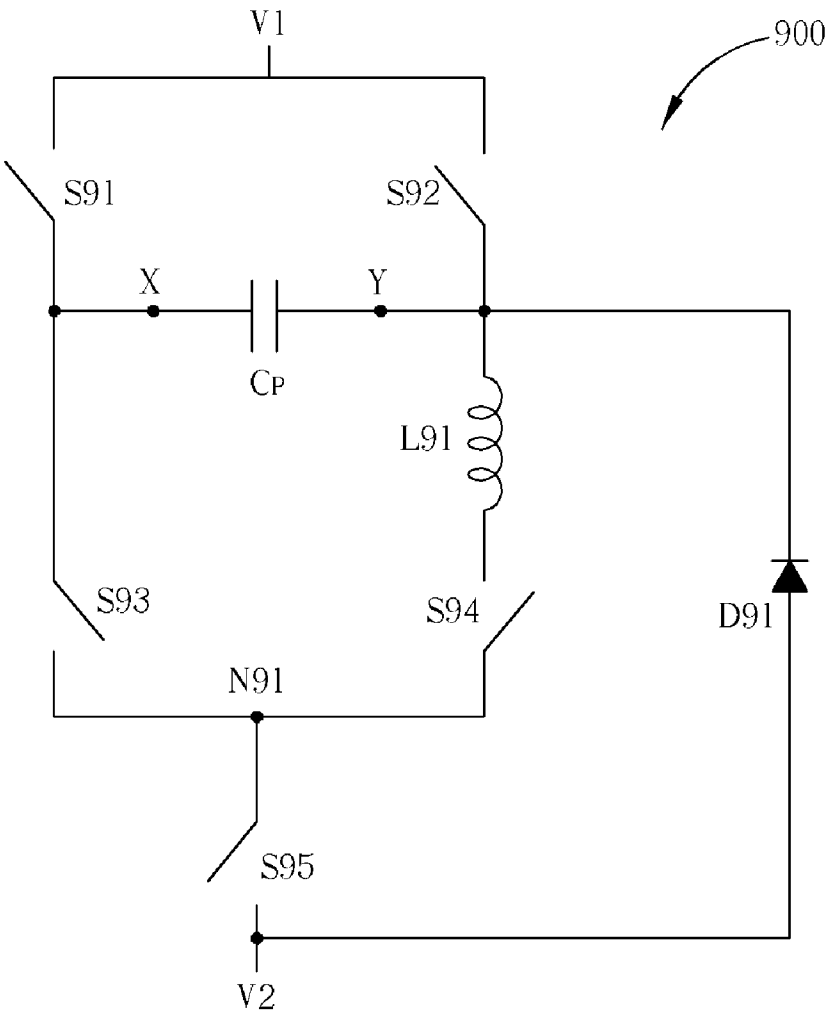
FIG. 9 is a plasma display panel driver circuit according to a fourth embodiment of the present invention.

Please refer to FIG. 9. FIG. 9 is a circuit diagram of a plasma display panel driver circuit 900 according to a fourth embodiment of the present invention. The driver circuit 900 comprises five switches S91, S92, S93, S94, and S95, a diode D91, and an inductor L91, coupled to an equivalent panel capacitor Cp of a plasma display panel. The driver circuit 900 is electrically connected to a voltage source V1 and a voltage source V2, wherein the voltage potential output by voltage source V1 is greater than the voltage potential output by voltage source V2. The voltage V1 is a positive voltage, whereas the voltage V2 can be ground or a negative voltage. Compared with the driver circuit 700 shown in FIG. 7, the driver circuit 900 switches the orientation of the X and Y sides of the panel capacitor Cp.

The switch S91 is electrically connected between the voltage source V1 and an X side of the panel capacitor Cp. The switch S92 is electrically connected between the voltage source V1 and a Y side of the panel capacitor Cp. The switch S93 is electrically connected between the X side of the panel capacitor Cp and a node N91. The switch S94 and the inductor L91 couple in series between the node N91 and the Y side of the panel capacitor Cp. The switch S95 is electrically connected between the node N91 and voltage source V2. The diode D91 is electrically connected between voltage source V2 and the Y side of the panel capacitor Cp.

Figure 10:
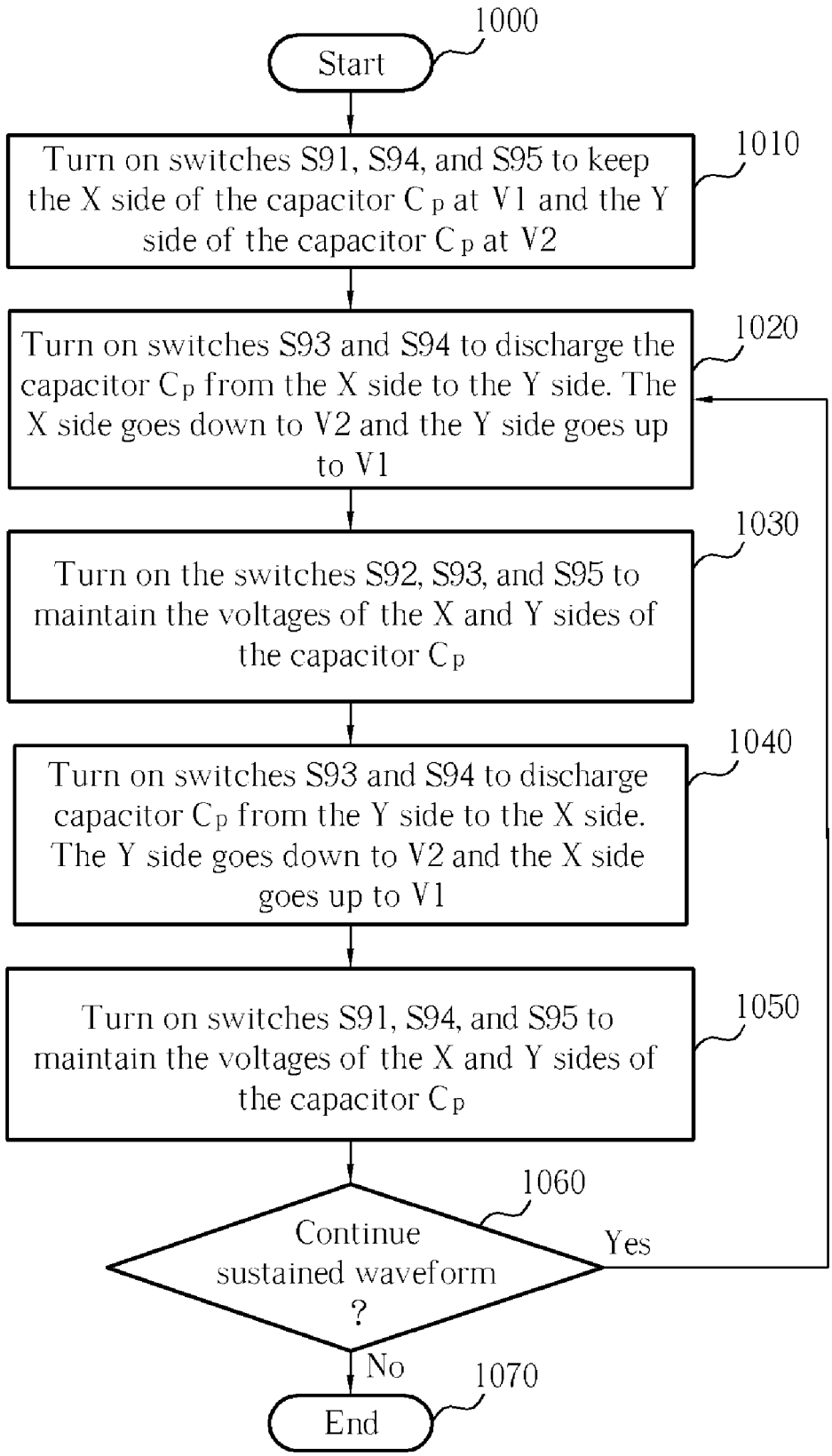
FIG. 10 is a flowchart illustrating the operation of the driver circuit of the fourth embodiment for creating a sustain waveform.

Please refer to FIG. 10, which illustrates the operation of the driver circuit 900 of the fourth embodiment for creating a sustain waveform. Steps contained in the flowchart will be explained as follows.

Step 1000: Start.

Step 1010: Keep the voltage potential at the X side of the panel capacitor Cp at V1 and the Y side of the panel capacitor Cp at voltage source V2 by turning on the switches S91, S94, and S95.

Step 1020: Discharge the panel capacitor Cp from the X side to the Y side by turning on the switches S93 and S94. The voltage potential at the X side of the panel capacitor Cp goes down to voltage source V2 and the voltage potential at the Y side of the panel capacitor Cp goes up to V1 accordingly and the path is through switch S93, switch S94, and inductor L91.

Step 1030: Keep the voltage potential at the X side of the panel capacitor Cp at voltage source V2 by turning on the switches S93 and S95. Keep the voltage potential at the Y side of the panel capacitor Cp at V1 by turning on the switch S92.

Step 1040: Discharge the panel capacitor Cp from the Y side to the X side by turning on the switches S93 and S94. The voltage potential at the X side of the panel capacitor Cp goes up to V1 and the voltage potential at the Y side of the panel capacitor Cp goes down to voltage source V2 accordingly and the path is through inductor L91 switch S94, and switch S93.

Step 1050: Keep the voltage potential at the X side of the panel capacitor Cp at V1 by turning on the switch S91. Keep the voltage potential at the Y side of the panel capacitor Cp at voltage source V2 by turning on the switches S94 and S95.

Step 1060: Go to step 1020 if the sustain waveform is continued. Otherwise, go to step 1070.

Step 1070: End.

The final status of the sustain waveform can keep the voltage potential at the X side of the panel capacitor Cp at voltage source V2 and the voltage potential at the Y side of the panel capacitor Cp at V1, or can keep the voltage potential at the X side of the panel capacitor Cp at V1 and the voltage potential at the Y side of the panel capacitor Cp at voltage source V2 or others. It will depend on waveform design.

The initial status of the sustain waveform can keep the voltage potential at the X side of the panel capacitor Cp at voltage source V2 and the voltage potential at the Y side of the panel capacitor Cp at V1, or can keep the voltage potential at the X side of the panel capacitor Cp at V1 and the voltage potential at the Y side of the panel capacitor Cp at voltage source V2. According to the different initial statuses, it can start from the different steps.

In addition, it is possible to turn off switch S93 in step 1040 and to turn on switch S95 in step 1050 before the voltage potential at the Y side of the panel capacitor Cp reaches voltage source V2 and before the voltage potential at the X side of the panel capacitor Cp reaches V1 accordingly.

In summary, the present invention provides embodiments of driving circuits that utilize fewer switches and fewer diodes than the prior art driving circuit. Only one diode is required instead of two diodes, and only five switches are required instead of six switches. Therefore, use of the present invention driving circuits reduces the space required on a semiconductor integrated circuit.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A plasma display panel driving circuit comprising:

an equivalent panel capacitor having a first side and a second side;

a diode electrically connected between the first side of the panel capacitor and a first voltage;

a first switch electrically connected between the first voltage and a first node;

a second switch electrically connected between the first node and the second side of the panel capacitor;

an inductor and a third switch electrically connected in series between the first node and the first side of the panel capacitor;

a fourth switch electrically connected between the second side of the panel capacitor and a second voltage; and a fifth switch electrically connected between the first side of the panel capacitor and the second voltage.

2. The plasma display panel driving circuit of claim 1, wherein the first voltage is greater than the second voltage.

3. The plasma display panel driving circuit of claim 2, wherein the diode has an anode coupled to the first side of the panel capacitor and a cathode coupled to the first voltage.

4. The plasma display panel driving circuit of claim 2, wherein the first voltage is supplied by a positive voltage source and the second voltage is ground.

5. The plasma display panel driving circuit of claim 2, wherein the first voltage is supplied by a positive voltage source and the second voltage is supplied by a negative voltage source.

6. The plasma display panel driving circuit of claim 1, wherein the first voltage is less than the second voltage.

7. The plasma display panel driving circuit of claim 6, wherein the diode has a cathode coupled to the first side of the panel capacitor and an anode coupled to the first voltage.

8. The plasma display panel driving circuit of claim 6, wherein the first voltage is ground and the second voltage is supplied by a positive voltage source.

9. The plasma display panel driving circuit of claim 6, wherein the first voltage is a negative voltage source and the second voltage is supplied by a positive voltage source.

10. The plasma display panel driving circuit of claim 1, wherein a first end of the inductor is electrically connected to the first node, and the third switch is electrically connected between a second end of the inductor and the first side of the panel capacitor.

11. The plasma display panel driving circuit of claim 1, wherein a first end of the inductor is electrically connected to the first side of the panel capacitor, and the third switch is electrically connected between a second end of the inductor and the first node.

12. The plasma display panel driving circuit of claim 1, wherein the first, second, third, fourth, and fifth switches are transistors.

13. The plasma display panel driving circuit of claim 12, wherein the transistors are P-type or N-type metal oxide semiconductor (MOS) transistors.

* * * * *